US009333435B1

(12) United States Patent
Kim

(10) Patent No.: US 9,333,435 B1
(45) Date of Patent: May 10, 2016

(54) CUSTOMIZED 3D PRINTING ROBOT

(71) Applicant: Sejong Industry-Academia Cooperation Foundation, Hongik University, Sejong (KR)

(72) Inventor: Na-young Kim, Seoul (KR)

(73) Assignee: SEJONG INDUSTRY-ACADEMIA COOPERATION FOUNDATION, HONGIK UNIVERSITY (KR)

( * ) Notice: Subject to any disclaimer, the term of this patent is extended or adjusted under 35 U.S.C. 154(b) by 11 days.

(21) Appl. No.: 14/585,340

(22) Filed: Dec. 30, 2014

(30) Foreign Application Priority Data

Nov. 26, 2014 (KR) ..... 10-2014-0166566

(51) Int. Cl.
*A63H 11/00* (2006.01)
*B62D 63/04* (2006.01)

(52) U.S. Cl.
CPC ..... *A63H 11/00* (2013.01); *B62D 63/04* (2013.01); *Y10S 901/01* (2013.01)

(58) Field of Classification Search
CPC ..... A63H 11/00; B62D 61/04; B62D 63/04; Y10S 901/01
USPC ..... 901/1, 6
See application file for complete search history.

(56) References Cited

U.S. PATENT DOCUMENTS

2012/0197439 A1* 8/2012 Wang ..... B25J 9/1689 700/259
2013/0203317 A1* 8/2013 Nagai ..... A63H 29/22 446/335
2015/0343641 A1* 12/2015 Maruyama ..... B25J 9/1697 700/259

FOREIGN PATENT DOCUMENTS

WO WO 2015073322 A1 * 5/2015 ..... B29C 67/0055

* cited by examiner

*Primary Examiner* — Faye M Fleming
(74) *Attorney, Agent, or Firm* — Cantor Colburn LLP

(57) ABSTRACT

A customized 3D printing robot that is configured such that components of the robot are produced using a 3D printing technology. In particular, the customized 3D printing robot enables a user to directly select an appearance design for each component and assemble the components so that an entire appearance design of the robot can be customized.

1 Claim, 13 Drawing Sheets

CUSTOMIZED 3D PRINTING ROBOT

BACKGROUND OF THE INVENTION

1. Field of the Invention

The present invention relates to a customized three-dimensional (3D) printing robot that is configured such that components of the robot are produced using a 3D printing technology. In particular, the invention enables a user to directly select an appearance design for each component before assembly of the components so that an entire appearance design of the robot can be customized according to a user's taste.

2. Description of the Related Art

Assembly toys, in particular, assembly robots, have been provided for the intellectual development and interest of children for a long time. These assembly robots have been developed to be operable using power.

According to the development of an assembly structure, an operation structure and so on of the assembly robots, the such robots have been developed as high-tech robots for studying, and enjoying basics, applications and so on of the robots as well as for playing of children and thus have been gradually utilized in the hobby activity of adults.

A representative one of these high-tech robots is MINDSTOMS® sold by LEGO Company of Denmark (hereinafter referred to as "MINDSTOMS"). MINDSTORMS is a product in which various kinds of joint components are assembled with a base kit (a program brick) including a CPU, various control modules, a motor, and the like so that the robot can be made in various forms. This product has been widely used in universities for introductory robotics and robotic programming courses.

Furthermore, many companies in the world have launched assembly robots that can be directly assembled and can be inputted with operation information by a user using various blocks and sensors.

One feature of these assembly robots is that the most of these assembly robots adopt a block or module type assembly method is adopted so that the robots can be assembled in various forms according to the user's taste, or a purpose for use of the robots.

However, even though the conventional assembly robots, such as the well-known MINDSTORM product produced by the LEGO Company, can be assembled by respective users in various forms, these robots are limited by predetermined component designs sold by the respective manufacturers. Thus, these robots may not be strictly customized robots.

That is, in the most of conventional assembly robots, shapes of the robots may only be changed according to each structure of the components, which have standardized designs for assembly and production convenience. Therefore, the appearance design of the completed robot is limited or is of poor quality.

In practice, the product of MINDSTORM of LEGO Company has a limit that it is difficult to assemble components. Furthermore, even though the product may be appropriate for the production of robots in different kinds and different operation modes because the robots are completed by merely the assembly of modulated components, the appearance designs of these robots has no distinctiveness because they are almost identical to each other when the same kind (or similar kind) of robots are produced. Accordingly, it is problematic in that the kinds and designs of robots, which can be produced by MINDSTORM, should be only implemented in an assembly structure verified on the Internet.

In particular, in the case of the conventional modulated assembly robots, the designs thereof may be necessarily restricted because components are standardized in a block form.

SUMMARY OF THE INVENTION

Accordingly, the present invention has been made keeping in mind the above problems occurring in the related art. An object of the present invention is to provide a customized 3D printing robot that is produced by customizing an appearance design of a main body and a base by a user using an image providing unit in which design information for each component is stored so that the appearance design of the robot can be tailor-made and provided. In particular, the present invention aims to provide a customized 3D printing robot in which components constituting the robot are produced by a 3D printer so that various kinds of components can be easily individually produced according to each design.

Furthermore, another object of the present invention is to provide a customized 3D printing robot having a driving means in a base of the robot so as to be variously operated regardless of an assembly form, structure and so on of the robot having various appearance designs.

Also, a further object of the present invention is to provide a customized 3D printing robot in which a base for a basic operation of the robot and a main body determining an appearance design of the robot have the same assembly structure, namely, an assembly means of a one-touch snap method, which is included for a combination of the main body and the base so that an operation of the robot can be easily performed via assembly of the main body and the base and a driving means regardless of a design selected by a user.

Moreover, yet another object of the present invention is to provide a customized 3D printing robot that is configured such that a user can easily obtain various kinds of design information about the robot; an appearance design of the robot can be easily customized by utilizing the design information; and components for each design or the robot can be easily individually customized by the user.

In order to achieve the above objects, according to one aspect of the present invention, there is provided a customized 3D printing robot, including:

a main body assembled in such a manner as to be directly customized by a user using an image providing unit in which design information for each component is stored and is to be outputted via a 3D printer;

a base assembled in such a manner as to be directly customized by the user using the image providing unit and is to be outputted via the 3D printer, and having a driving means; and an assembly means for connecting the main body and the base, wherein the assembly means includes:

an assembly member composed of a protrusion portion formed to protrude from a bottom of the main body, and a circular body, wherein the circular body is connected to an upper end of the protrusion portion so as to be elastically supported inwardly from the bottom of the main body and has a circular inclined portion, a height of an upper surface being inclined to one side;

a pressure protrusion installed to protrude around the assembly member from the bottom of the main body, and having a ring portion in contact with the circular inclined portion at an upper end;

an assembly hole provided in an upper surface of the base, and into which the protrusion portion is inserted;

an elastic member provided on the assembly hole of the base and having a circular twist portion inserted into a coupling groove of the protrusion portion; and a button portion linked with a separation button provided at an outer side of the base to pressurize the pressure portion of the elastic member exposed to an outer side of the assembly hole.

The customized 3D printing robot according to the present invention enables the provision of various kinds of designs for each component constituting the robot and enables freely customizing the entire appearance design of the robot according to the user's taste, use purpose and so on. Thus, unlike conventional robots that are standardized or have limited designs, the customized 3D printing robot has excellent distinctiveness and utility that can fulfill the user's esthetic requirements.

In particular, the customized 3D printing robot according to the present invention can be immediately produced and provided to correspond to a design selected by the user because the components of the robot are individually produced using a 3D printing technology, and the customized 3D printing robot is effective to provide customized services appropriate for various kinds of small production.

Also, it is easy to produce the customized 3D printing robot according to the present invention because the base corresponding to a basis of the robot and the main body determining an entire appearance design of the robot can be individually produced according to each component and can be then easily assembled using a one-touch snap assembly means. In particular, the customized 3D printing robot can more faithfully fulfill the user's esthetic requirements because an appearance design of the main body can be more freely customized by the user regardless of an assembly structure of the main body and the base.

Furthermore, since the customized 3D printing robot according to the present invention has no limit in customization of the appearance design of the robot, the robot can be utilized for education and learning purposes for children's intelligence development, adults' knowledge acquisition and so on, as well as utilization for simple hobby or play purposes, and thus the robot can be very extensively used.

Also, it is convenient to use the customized 3D printing robot according to the present invention because the robot can be customized by the user based on design information for respective components stored in the image providing unit provided via a user terminal such as a smart phone.

In particular, the customized 3D printing robot according to the present invention is a very useful invention capable of maximizing the user's convenience because the user can store and use model information about designs of the main body and the base finally determined based on the image providing unit, or model information about a changed design in real time so as to freely select an appearance design of the robot with enough time and to order the robot.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1A:
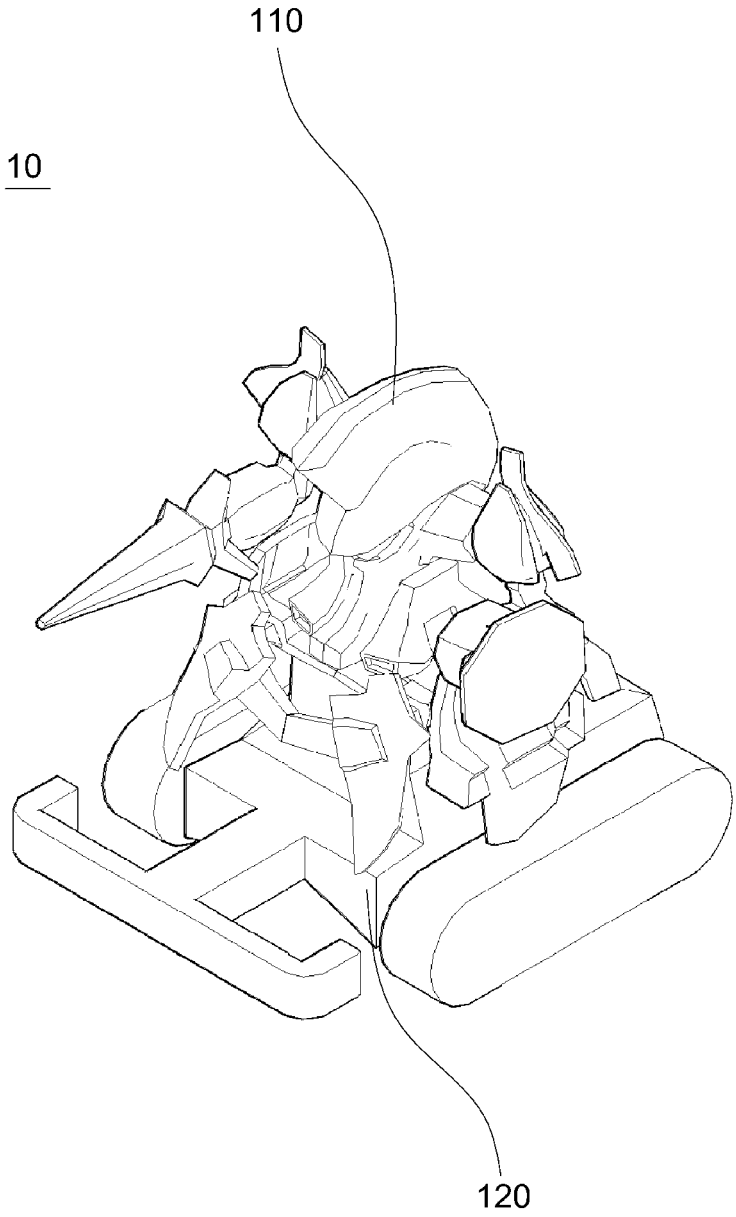
FIGS. 1A and 1B are an exterior perspective view and a primarily exploded perspective view illustrating one exemplary embodiment of a customized 3D printing robot according to the present invention, respectively.

The present invention will now be described in detail based on aspects (or embodiments). The present invention may, however, be embodied in many different forms and should not be construed as being limited to only the embodiments set forth herein, but should be construed as covering modifications, equivalents or alternatives falling within ideas and technical scopes of the present invention.

In the figures, like reference numerals, particularly, tens and units, or reference numerals having like tens, units and letters refer to like elements having like functions throughout, and unless the context clearly indicates otherwise, elements referred to by reference numerals of the drawings should be understood based on this standard.

Also, for convenience of understanding of the elements, in the figures, sizes or thicknesses may be exaggerated to be large (or thick), may be expressed to be small (or thin) or may be simplified for clarity of illustration, but due to this, the protective scope of the present invention should not be interpreted narrowly.

The terminology used herein is for the purpose of describing particular aspects (or embodiments) only and is not intended to be limiting of the present invention. As used herein, the singular forms are intended to include the plural forms as well, unless the context clearly indicates otherwise.

It will be further understood that the terms "comprises," "comprising,", "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the present invention belongs. It will be further understood that terms used herein should be interpreted as having a meaning that is consistent with their meaning in the context of this specification and the relevant art and will not be interpreted in an idealized or overly formal sense unless expressly so defined herein.

Terms such as 'a first ~' and 'a second ~' are used only for the purpose for distinguishing a constitutive element from other constitutive element, but constitutive element should not be limited to a manufacturing order, and the terms described in the detailed description of the invention may not be consistent with those described in the claims.

Figure 1B:
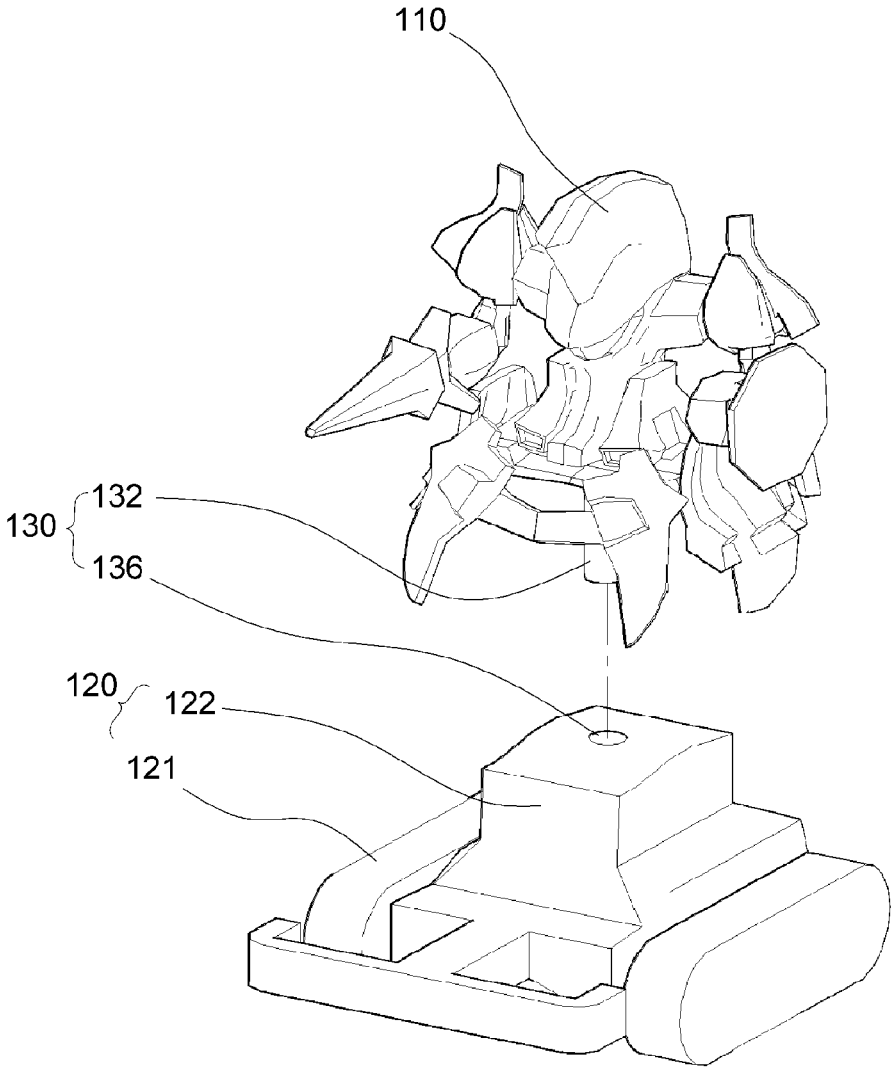

For convenience of the description of a customized 3D printing robot according to the present invention, when an approximate direction rather than a precise direction is specified with reference to FIG. 1B, a lower side is determined based on a direction to which gravity is applied, and up and down directions and right and left directions are determined based on the lower side. This standard may be also applied to the other drawings, and directions may be specified and described based on this standard unless the detailed description of the invention and the claims specially indicate otherwise.

Hereinbelow, a customized 3D printing robot according to the present invention will be described with reference to the accompanying drawings.

First, as illustrated in FIGS. 1A, 1B, 3A to 3E and 4, a customized 3D printing robot 10 according to the present invention largely includes: a main body 110 that forms an entire appearance of the robot; and a base 120 that is a basis of the robot.

The fact that the main body 110 forms the entire appearance of the robot only means that the main body serves as a relatively important factor for determination of the appearance design compared to the base 120, but does not mean that the base 120 does not serve as an appearance design factor for the robot. That is, the main body 110 has a larger effect than the base 120 on determination of the design.

First, the main body 110 is realized by assembly of various components. For example, in the case of a half-human robot as shown in the drawings, individual components for the head, body, arm, and the like of the robot are basically assembled by the medium of respective joints. The base 120 may serve as a member in place of legs for making the robot stand or move.

Of course, unlike the drawings, the main body 110 may be produced in such a manner that all constitutive elements of a complete human robot including the head, body, arms and legs are individually assembled according to each component. At this time, the base 120 is assembled at a sole part of the legs so as to be used as a member for making the robot stand or move.

In addition, the main body 110 may be produced in various designs based on the appearance of an animal robot, the appearance of a vehicle robot and so on. In the drawings, even though the base 120 is illustrated in the same design, the detailed configuration of the base 120 may be also changed according to various appearance forms, structures or the like of the robot.

Furthermore, the robot of the present invention is characterized in that designs for each component of the main body 110 and the base 120 may be directly selected by a user so that an entire appearance of the robot can be freely customized.

That is, by utilizing an ordering system that will be described later, the user may select detailed elements and designs of the main body 110 and the base 120 based on 3D image information (design information) for each component that has been stored in an image providing unit 20 (see FIG. 2) in advance by a seller.

Figure 4:
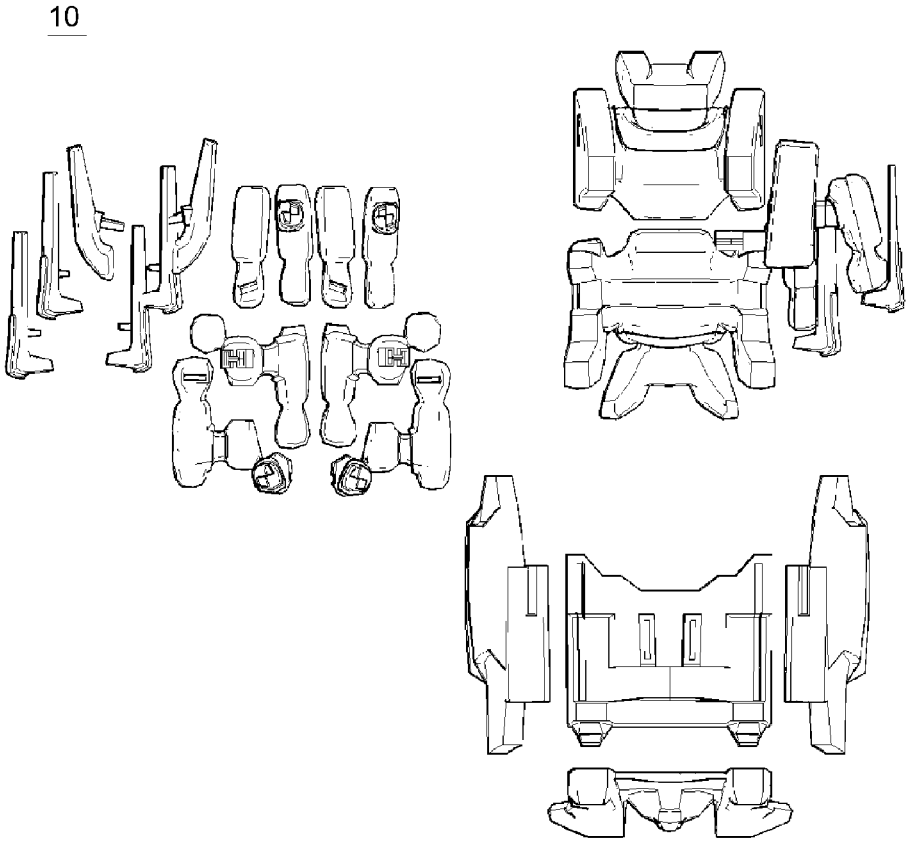
FIG. 4 is a view illustrating designs for each component of a main body of the customized 3D printing robot according to the present invention.

Here, the design information for each component refers to information in which various designs are adopted to individual components including various kinds of accessories constituting the appearance of a robot (see FIG. 4).

That is, as shown in the accompanying drawings of the specification, the robot is a half-human robot having a main body composed of the head, body and arms and includes a driving means having a driving member 121 in which the base 120 is connected to a motorized track unit.

In such a case, a neck joint, each joint of body and arms or a part thereof corresponding to the main body 110, accessories, which can be added to each part, and the driving member 121 and a base frame 122 corresponding to the base 120 are all produced as individual components. These individual components are previously stored by a seller in the image providing unit 20 as 3D models. At this time, various designs (from several to dozens) for the individual components are stored in the image providing unit 20.

Furthermore, the user directly selects components constituting one robot according to his or her taste, and as a result, appearances of the main body 110 and the base 120 are determined by assembly of the selected components.

Accordingly, unlike the conventional robots, since the customized 3D printing robot according to the present invention can enable the user to directly customize an entire design of the robot, an individual style of robot can be provided according to the user's taste.

That is, for example, when the number of entire components of the robot is 10, and 10 designs are adopted to each component, the robot may be assembled in a total of 100 designs that are different from each other.

Furthermore, the main body 110 and the base 120 are outputted and produced by a 3D printer 50.

The 3D printer 50 outputs each component as three-dimensional images according to design information for each component stored in the image providing unit 20, namely, 3D image information for each component.

Examples of the 3D printer may include various types of known 3D printers such as a laminated type (rapid prototype) output device that outputs 3D images by laminating the components as the 3D images using various power materials of plastic, rubber, metal, ceramic and so on, and a cutting type output device that cuts the appearance of a mass of solid material as carving.

Also, the 3D printer 50 may be an output device including a customizing tool and a 3D scanner. Since the configuration of such a 3D printer 50 is a publicly known technology, the detailed description thereof is omitted herein.

Meanwhile, the user selects individual designs for each component, so that the robot is completed by connecting the main body 110 to an upper part of the base 120 in a state of the customized main body 110 and base 120 being assembled according to each component.

The main body 110 may be configured such that the main components constituting the main body 110 are assembled in a joint structure (for example, a ball join doll-like joint structure) so that the components can be individually operated (wherein the operation includes both an automatic operation using a driving means that will be described later, and a manual operation performed by the user for adjustment of the forms, positions and so on of each component).

Furthermore, since the base 120 has a driving means, the base may be automatically driven using the user's terminal or various consoles, pre-stored programming, various sensors, or the like.

More specifically, as illustrated in FIGS. 1A and 1B, the base 120 includes: a base frame 122 having an upper part to which the main body 110 is connected; and a driving means composed of a driving member 121 including at least one motor, various gears or axes or both, wheels or joints operated by a driving force transmitted from the motor, and so on.

In these drawings, an example in which a motorized track unit is adopted as the driving member 121 can be confirmed. Even though it is not illustrated in the drawings, a size, shape, number and color of the driving member 121, a form of the motorized track unit, a position of a communication unit 123 or a sensing unit 126 and so on may be selected by the user based on various kinds of 3D image information previously stored in the image providing unit 20 (of course, a design of the base frame 122 may be also selected according to circumstances).

Accordingly, the base 120 of the present invention having the driving means is a basis for supporting the main body 110 and covers all forms for performing actual movement of the robot.

Figure 5:
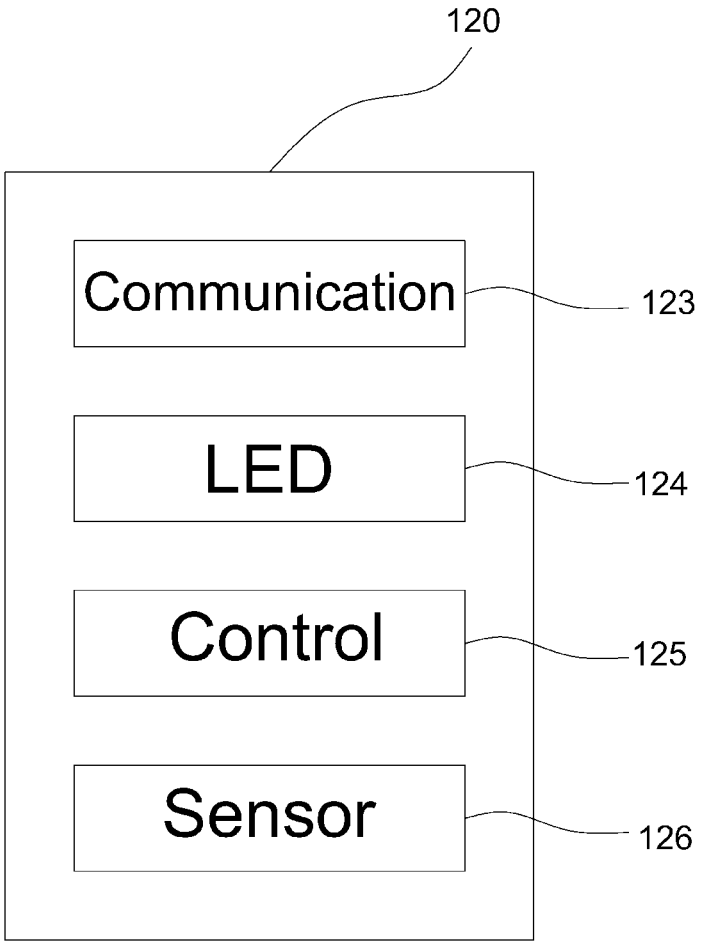
FIG. 5 is a view illustrated to explain elements added to a base of the customized 3D printing robot according to the present invention.

Also, as illustrated in FIG. 5, in addition to the driving member 121, the base 120 may further include: a communication unit 123; a light emitting unit 124; a drive controlling unit 125; and a sensing unit 126, thereby implementing an operation and movement of the robot via the driving means.

The communication unit 123 is intended to receive operating signals transmitted from a radio controller such as a smart device or various consoles used as a user terminal 30 (see FIG. 2) and can have both wire and radio modes. An RF communication, Bluetooth, an infrared ray communication method and so on may be applied as a representative radio mode.

Furthermore, the light emitting unit 124 includes at least one light emitting element (for example an LED light source and so on) and functions to display an operational state of the 3D printing robot to user.

For example, when the robot is moving or is in a stop state, the light emitting unit 124 may be operated in such a manner as to emit light in a fixed color or to flash.

Next, the drive controlling unit 125 controls driving of the driving member 121 according to a control signal transmitted and received via the user terminal 30.

Furthermore, the drive controlling unit 125 enables the robot to be driven by a predetermined operation (or movement) according to previously stored operation programming without any separate control. In this case, as the drive controlling unit is linked with the sensing unit 126 that will be described later, the operation is automatically controlled.

In addition, the sensing unit 126 includes various sensors provided at the front, the rear, the right and the left of the base frame 122.

The sensing unit 126 transmits information collected from various sensors to the drive controlling unit 125 so that the robot can automatically convert a movement direction when the robot meets an obstacle upon movement (e.g., a proximity sensing sensor) or the robot can perform a specific operation upon collecting specific information (a voice recognition sensor).

As illustrated in FIGS. 1A and 1B, the main body 110 and the base 120, which are configured as described above, are connected to each other via an assembly means 130.

The assembly means 130 includes: a protrusion portion 132 protruding to a lower part of the main body 110; and an assembly hole 136 provided at an upper surface of the base 120, wherein the protrusion portion 132 is inserted into the assembly hole 136 so that various assembly structures adoptable to general assembly robots such as a combination type, a bolt combination type, a screw tightening type and so on can be used.

Also, in addition to the assembly means 130, even though a driving force transmitting means (not drawn) is not illustrated in the drawings, the customized 3D printing robot of the present invention may further include the driving force transmitting means that enables the components of the main body 110 to be individually operated by transmitting a driving force of the driving means such as a motor and the like mounted in the base 120 to the main body 110.

The driving force transmitting means includes various kinds of mediation gears or axes or both connected to the motor. These mediation gears or axes or both are connected to joints and so on of the components of the main body 110 so that the main body 110 can be also individually operated according to a control signal of the user terminal 30 or the drive controlling unit 125.

Meanwhile, since the present invention has a form in which the driving means is embedded in the base 120, it is more preferable to increase the convenience of assembly by introducing a standardized assembly means to the bottom of the main body 110 and an upper surface of the base 120.

That is, as the standardized assembly means is introduced to a contact surface of the main body 110 and the base 120 except from a part exposed to the outside and determining an entire appearance design of the robot, assembly can be easily performed.

In particular, in the present invention, the one-touch snap assembly means 130 among various assembly methods is introduced so that assembly and separation of the main body 1110 and the base 120 can be easily performed.

Figure 6:
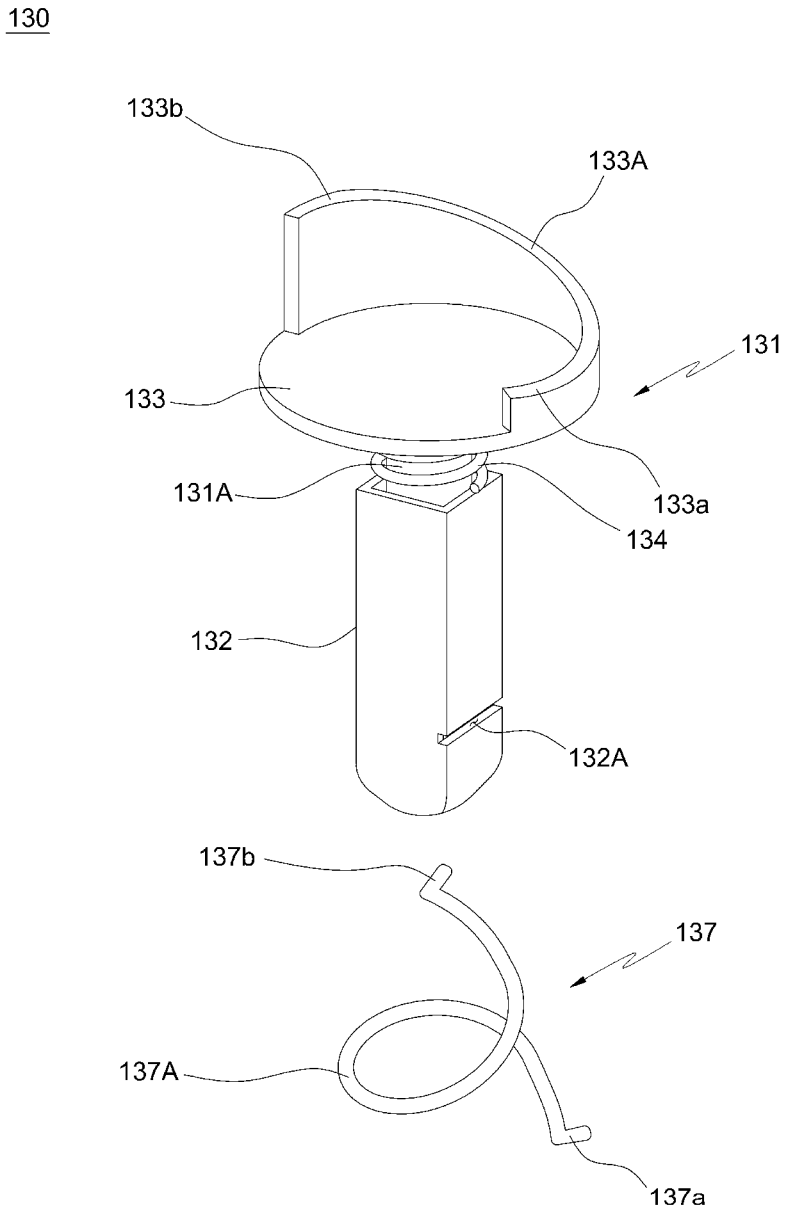
FIGS. 6, 7A and 7B are a perspective view of main parts and cross-sectional views according to each assembly state, illustrated for explaining an assembly means of the customized 3D printing robot according to the present invention.
Figure 7A:
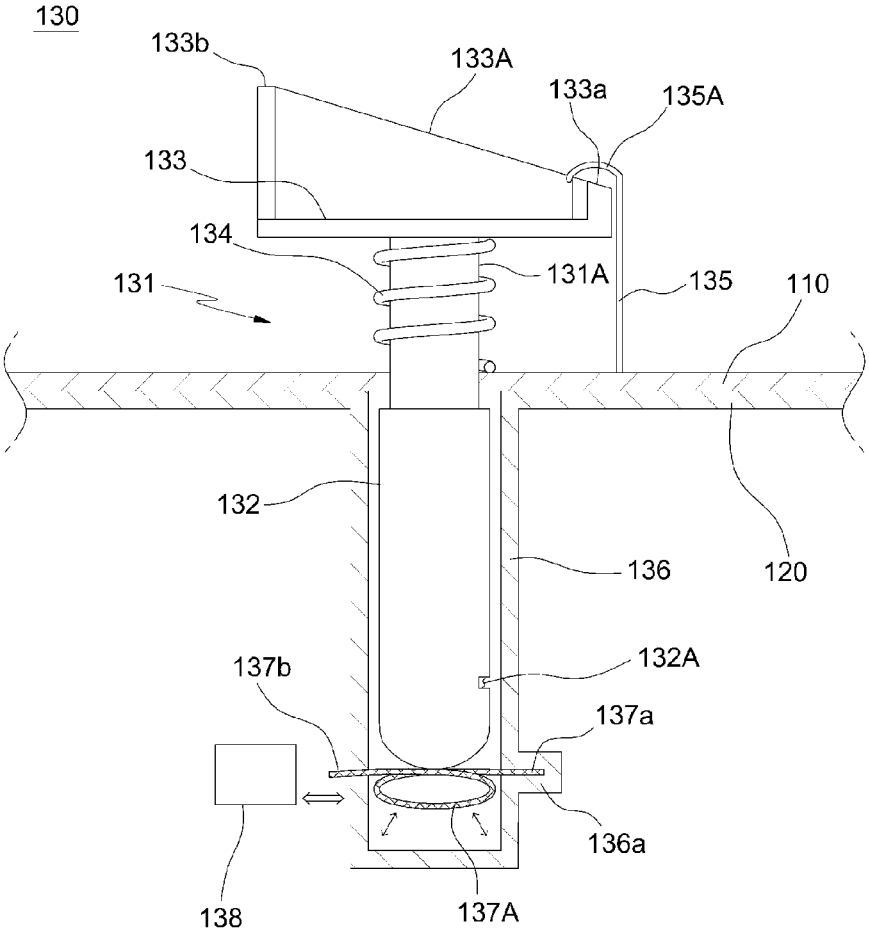
Figure 7B:
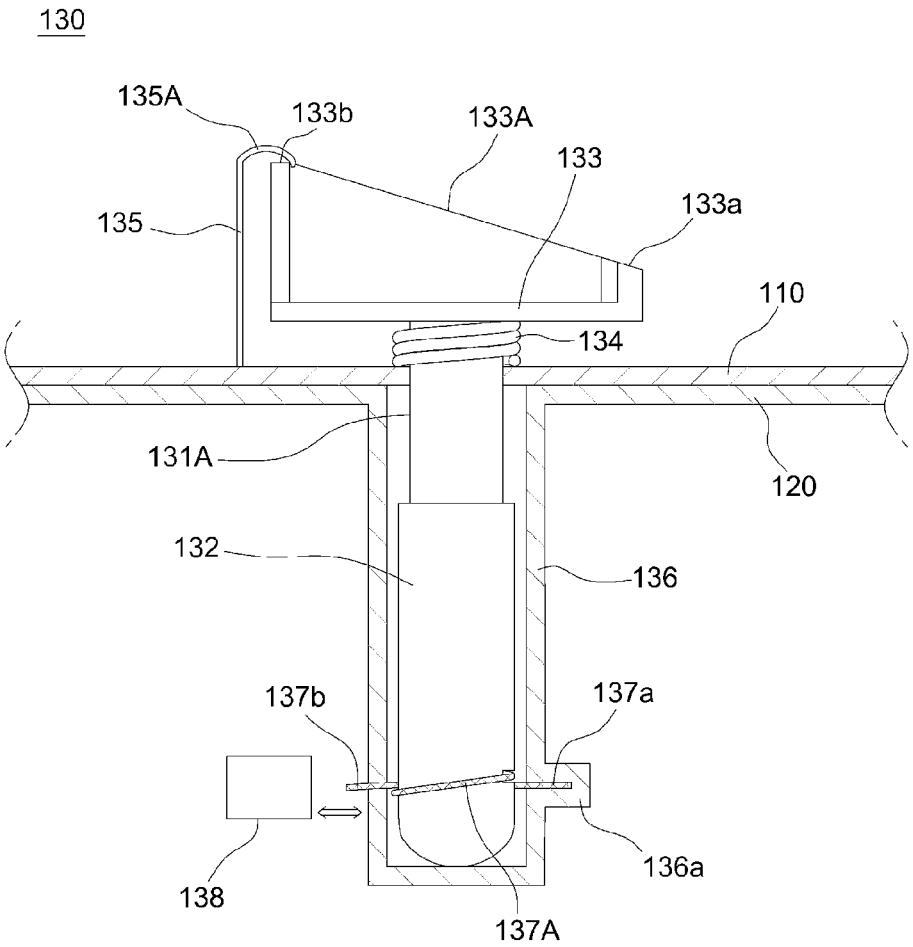

To do so, as illustrated in FIGS. 6, 7A and 7B, the assembly means 130 includes: an assembly member 131 composed of the protrusion portion 132, and a circular body 133, wherein the circular body is connected to an upper end of the protrusion portion 132 so as to be elastically supported inwardly from the bottom of the main body 110 and has a circular inclined portion 133A, a height of an upper surface being sloped to one side;

a pressure protrusion 135 installed to protrude around the assembly member 131 from the bottom of the main body 110 and having a ring portion 135A in contact with the circular inclined portion 133A at an upper side end; and an elastic member 137 provided on the assembly hole 136 of the base 120 and having a circular twist portion 137A inserted into a coupling groove 132A of the protrusion portion 132.

First, in the assembly member 131, a coil spring 134 is connected to a connection portion 131A for connecting the protrusion portion 132 and the circular body 133 so that the circular body 133 can be elastically supported inwardly from an upper part of the bottom of the main body 110.

Furthermore, the pressure protrusion 135 is disposed on the lowest side part 133*a* of the circular inclined portion 133A. Thus, when the main body 110 is rotated based on the assembly member 131 as an axis, the ring portion 135A is rotated along the circular inclined portion 133A, thereby enabling the circular body 133, namely, the assembly member 131 to downwardly protrude to the outside of the main body 110.

Since the protrusion portion 132 and the assembly hole 136 are formed in a polygonal shape, when the protrusion portion 132 is inserted into the assembly hole 136, the protrusion portion 132, namely, the assembly member 131, is not rotated, and the coupling groove 132A is concavely formed on an outer circumferential surface of one side of the protrusion portion 132.

Furthermore, an elastic member 137 is a kind of torsion spring and shows elasticity in a direction in which end parts of both sides of the circular twist portion 137A are opened, namely, a direction in which the circular twist portion 137A is closed.

The end part of one side of the elastic member 137 is fixedly connected to an installation groove 136*a* of the assembly hole 136, thereby functioning as a fixing portion 137*a*. The end part of another side is exposed to the outer side of the assembly hole 136, thereby functioning as a pressure portion 137*b*.

Accordingly, in order to assemble the main body 110 and the base 120, when the main body 110 is rotated to one side in a state where the protrusion portion 132 is primarily inserted into the assembly hole 136, the ring portion 135A of the pressure protrusion 135 is also rotated along the circular inclined portion 133A of the circular body 133.

Furthermore, the ring portion 135A presses the circular body 133 downwardly while moving to the uppermost side part 133*b* of the circular inclined portion 133A, thereby enabling the protrusion portion 132 of the assembly member 131 to downwardly protrude.

Thus, when the protrusion portion 132 descends in the assembly hole 136 and enters a hollow part of the circular twist portion 137A (for the convenience of description, FIG. 7A illustrates the hollow part of the circular twist portion 137A in a visible form), the circular twist portion 137A is opened, thereby enabling the protrusion portion 132 to pass through the hollow part.

Furthermore, when the assembly member 131 downwardly protrudes, the coupling groove 132A reaches a height of the circular twist portion 137A and thus the circular twist portion 137A is closed again by elasticity and is inserted into the coupling groove 132A so that the protrusion portion 132, namely, the assembly member 131 can be fixed to the assembly hole 136, thereby completing assembly of the main body 110 and the base 120.

In this state, the assembly member 131 and the bottom of the main body 110 are pressurized by compression of the coil spring 134 to be far away from each other, and the protrusion portion 132 of the assembly member 131 is bound by the elastic member 137 so as not to ascend.

Thus, since the main body 110 may not be rotated in another direction from the base 120, a strong assembly state of the main body 110 and the base 120 is maintained.

A separation button (not drawn) is provided at an outer side of the base 120, and a button portion 138 connected to the separation button is disposed at the end part of another side of the elastic member 137, namely, on the pressure portion 137*b*.

Accordingly, when a user presses the separation button for separation of the main body 110 and the base 120, the button portion 138 connected thereto pressurizes the pressure portion 137*b* of the elastic member 137 so that the circular twist portion 137A can be opened to be separated from the coupling groove 132A, thereby releasing the protrusion portion 132.

Furthermore, in this state, when the main body 110 is rotated in another direction, the ring portion 135A moves to the lowest side part 133*a* of the circular inclined portion 133A so that pressurization is released.

Thus, the assembly member 131 is upwardly moved by the elasticity of the coil spring 134. As a result, the protrusion portion 132 is separated from the circular twist portion 137A so that the protrusion portion 132 can be separated from the assembly hole 136.

As described above, according to the present invention, assembly and separation can be easily performed and an assembled state can be firmly maintained because coupling of the assembly means 130 is realized in a one-touch snap method using rotation of the main body 110.

Next, an ordering system of the customized 3D printing robot using the present invention will be described.

Figure 2:
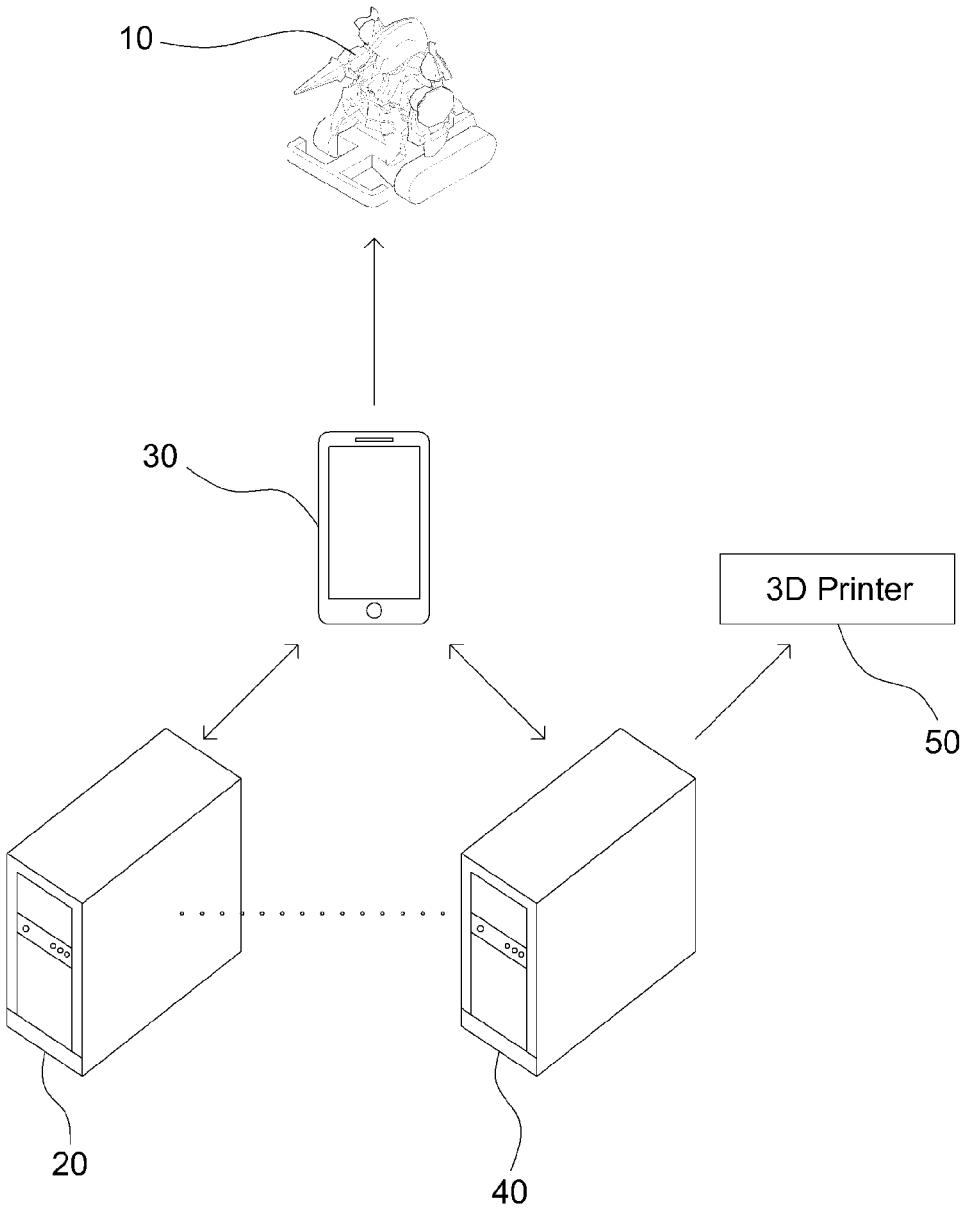
FIG. 2 is a view schematically illustrating an ordering system of the customized 3D printing robot according to the present invention.

First, as illustrated in FIG. 2 (for the detailed configurations of the robot which are not illustrated in FIG. 2, please refer different drawings), the ordering system of the present invention includes: the image providing unit 20; the user terminal 30; the storage unit 40; and the 3D printer 50.

The image providing unit 20 is adopted to store different kinds of design information for each individual component of the main body 110 and the base 120 and to provide design information for each component to the user terminal 30 via a network such as an internet communication network.

The image providing unit 20 includes an IP authentication server that receives unique identification information of the user terminal 30 and matches it with unique identification information stored in the inside thereof, thereby transmitting the design information for each component to the user terminal 30 when the unique identification information is identical to the unique identification information stored in the inside.

Furthermore, the user terminal 30 is embedded with an application linked with the image providing unit 20, and the user may connect to the image providing unit 20 via the application to receive image information for each component of the robot.

The user may confirm design information for each component provided via the application and may customize the main body 11 and the base 120 by selecting components according to his or her taste.

The customized information is stored in the storage unit 40 which will be described later. Thus, when the user finally determines the components and transmits a purchase signal (an ordering signal) via the application, the 3D printer 50 outputs the components as 3D images based on the customized information.

Figure 3A:
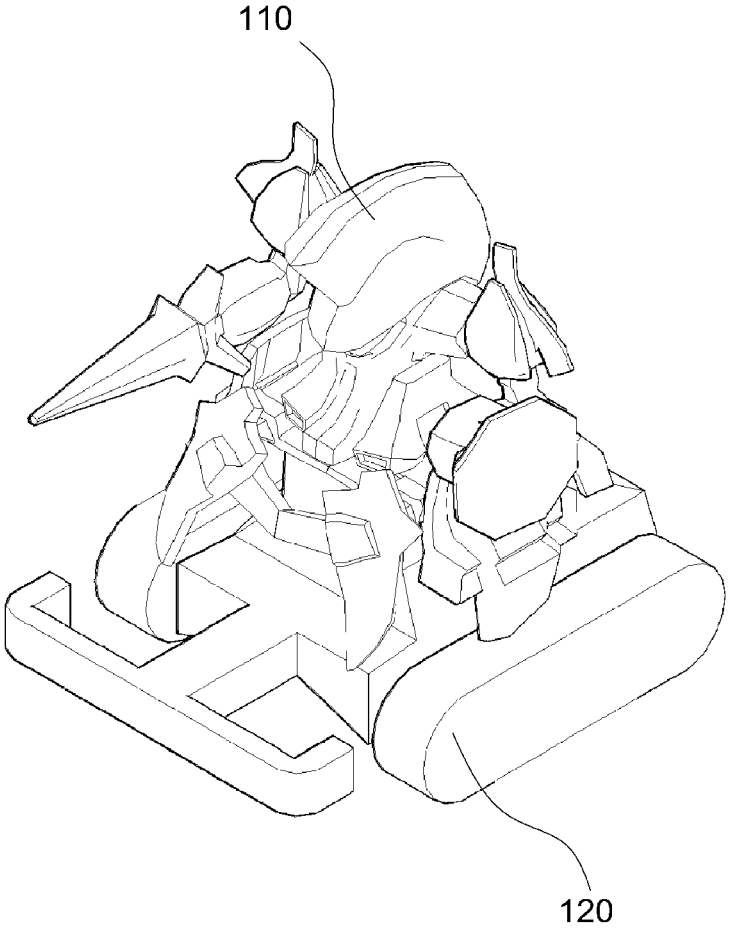
FIGS. 3A to 3E are views illustrated for explaining customizing the customized 3D printing robot.
Figure 3B:
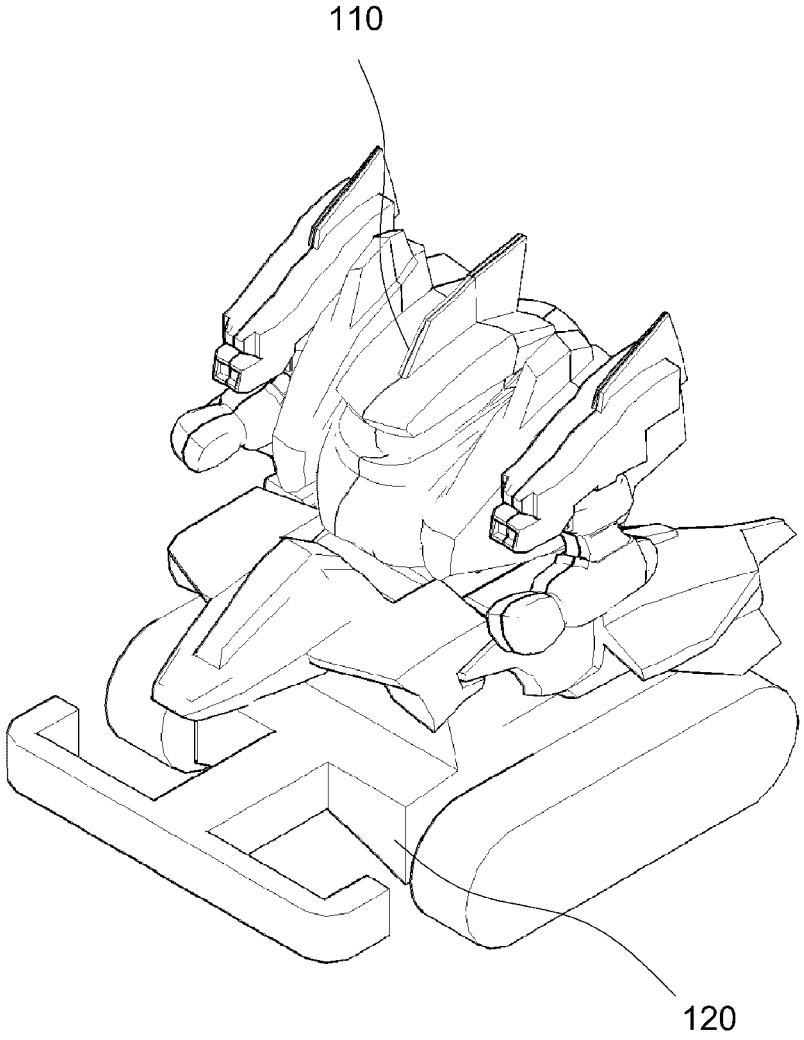
Figure 3C:
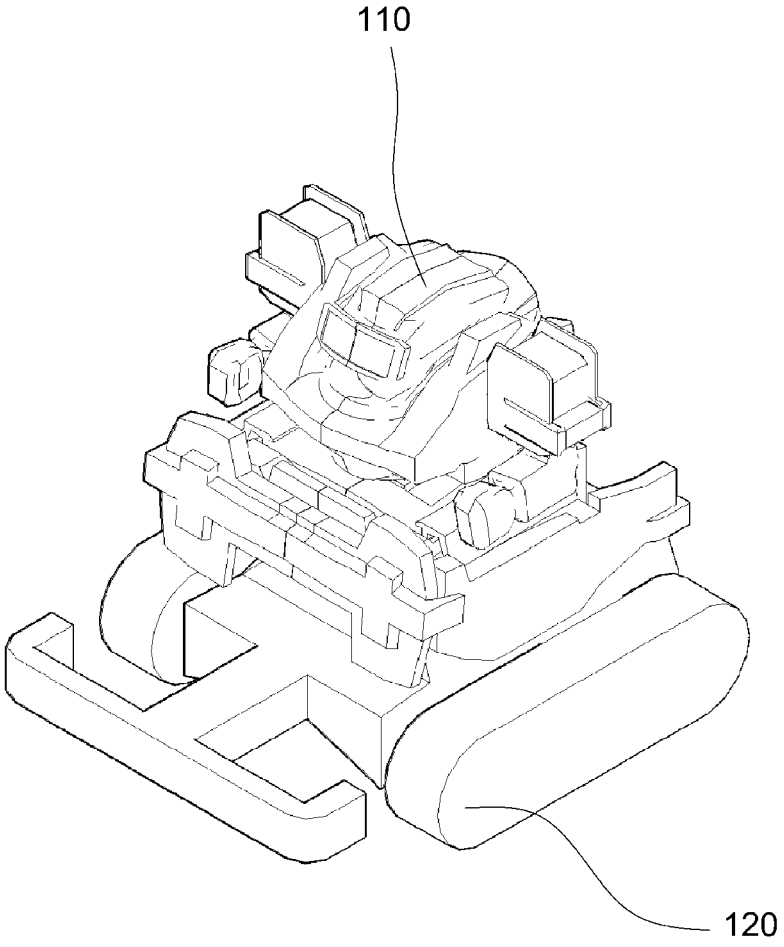
Figure 3D:
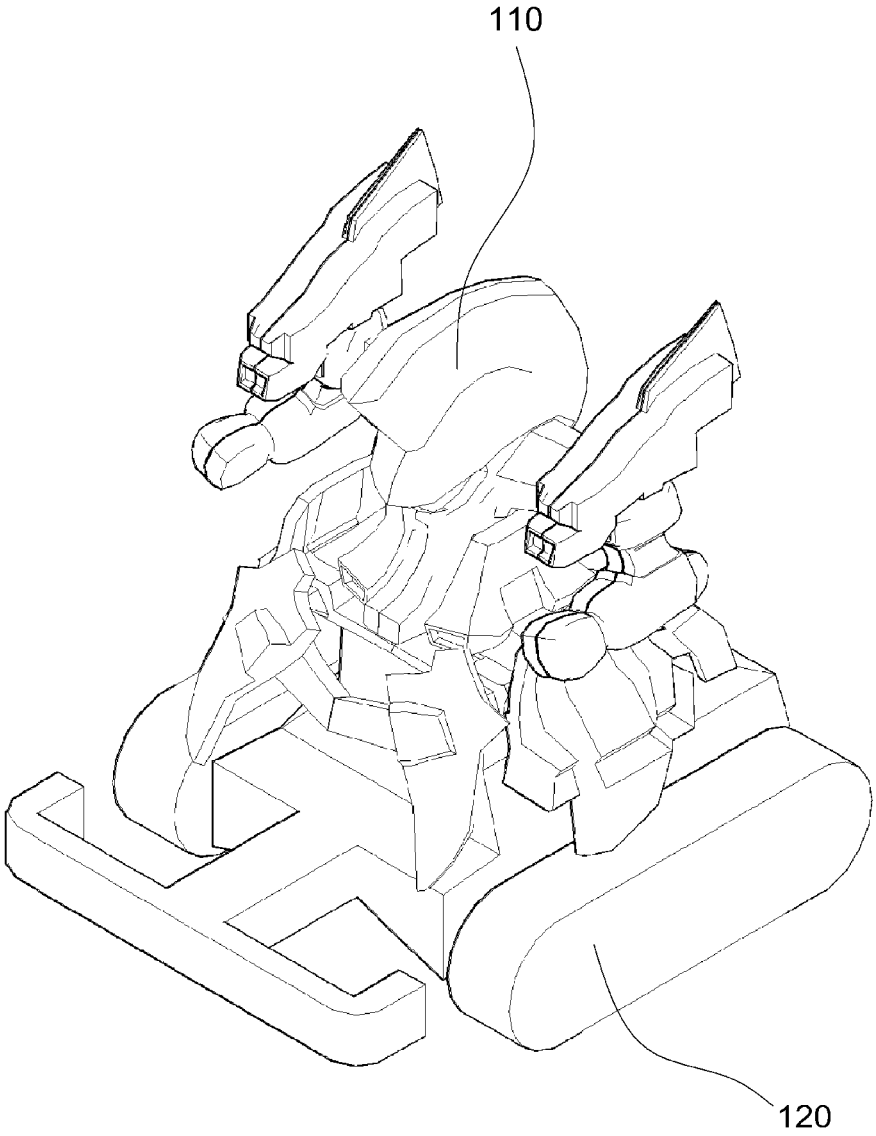
Figure 3E:
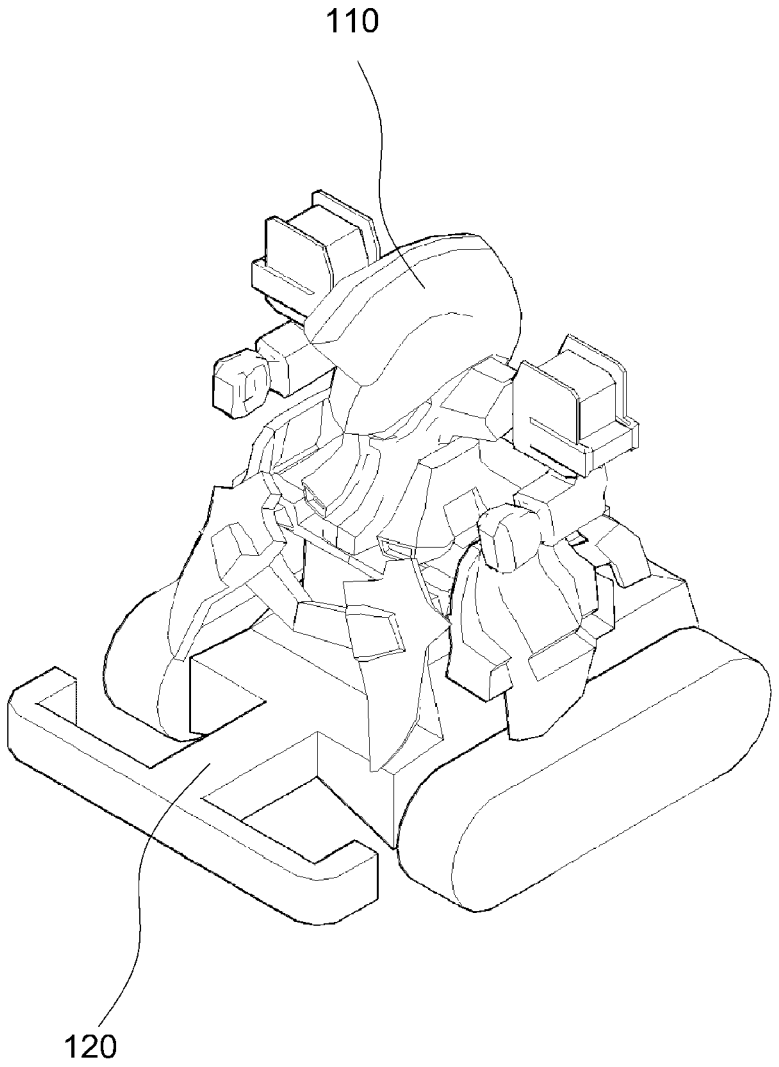

At this time, in addition to providing design information for each component as 3D images, the application may display an assembled state of selected components to the user (see FIGS. 3A to 3C) and may enable the user to change, exchange and confirm designs according to each component in the assembled state (see FIGS. 3D to 3E).

Also, the application may support a function of displaying rotation and movement information for each individual component, or adjusting a size, color and so on for each individual component.

Furthermore, the application includes a file input and output function of transmitting and storing assembly information of the robot (or component selection information) according to the user's taste to the storage unit 40 and re-loading the information.

Meanwhile, the user terminal 30 may function to enable the user to directly control an operation of the robot via transmitting or receiving data.

The user terminal 30 may be a smart device such as a general smart phone, a tablet PC or the like capable of downloading an operation application via a general market or may be an electronic device such as a joy stick or a joy pad, a radio controller embedded with an operation application, or the like.

For reference, examples of the user terminal 30 provided in the present invention include predetermined communication modules, such as a Bluetooth module, an infrared-ray communication module (infrared data association), and a radio communication device in which a wire and radio LAN card and a DGPS chip for enabling position-tracking via a GPS (Global Positioning System) are mounted.

The user terminal refers to all kinds of terminals capable of performing predetermined arithmetic operations with a microprocessor embedded in the user terminal.

Next, the storage unit 40 receives and store selected customizing information of the main body 110 and the base via the application.

Here, the customizing information stored in the storage unit 40 includes information (final result) about the designs for each component finally selected by the user and partial design information for each component or information (intermediate result) before rendering a final determination.

The storage unit 40 stores these results so that the user can search the stored information at any time via the application of the user terminal 30 and can re-load the information.

The image providing unit 20 and the storage unit 40, which are a database, may be integrally installed as one device.

Next, when the user completes an order via the user terminal 30, the 3D printer 50 loads the customizing information of the storage unit 40 and individually outputs, as 3D images, each component of the main body 110 and the base 120 based on the customizing information.

The components finally outputted as the 3D images may be first assembled by a seller according to delivery request information transmitted by the user via the application, and thereafter, the robot in a completed state may be delivered, or individual components in a non-assembled state may be delivered to the user so that the user can directly assembly the components.

Hereinafter, robot production and providing services using an ordering system of the customized 3D printing robot of the present invention will be described.

First, the user downloads a free application distributed by a seller to the market with the user terminal 30 such as, a smart phone and the like (when the user terminal is a separate radio controller, the application is previously mounted) and connects to the image providing unit 20 by driving the application.

The user confirms design information for each component of the main body 110 and the base 120 of the robot, which has been previously stored by the seller, using the application and also confirms individual component designs, an entire design of an assembled robot, and so on, thereby performing customizing according to his or her taste.

At this time, information about component designs selected by the user during customizing is stored in the storage unit 40 in real time or is stored in the storage unit 40 upon the user's separate storage request.

The user may select component designs, namely, an appearance, a size, a color and so on of the components by storing information about an intermediate result of customizing and re-loading the information to judge an entire appearance design of the robot from various angles with enough time.

As such, when the user performs a purchase request via a web server of the seller using the application after completing the selection of designs based on design information for each component of the robot, the web server loads customizing information finally stored in the storage unit 40 and transmits the information to the 3D printer 50.

The 3D printer 50 outputs the components as 3D images for each component based on the loaded customizing information, thereby completing order and production of the robot.

The produced components may be delivered in a non-assembled state, or the completed robot may be delivered after the components have been assembled by a seller.

At this time, the user the user may select and order specifications of the driving member 121 and the like using the application.

Also, when a general PC is used as the user terminal 30, the user may download design information for each component from the image providing unit 20 and may directly change appearance designs of the components using a 3D modeling program, thereby storing changed design information in the storage unit 40.

In this case, when the user directly changes the designs of each component and stores the changed design information in the storage unit 40, the storage unit 40 compares the updated design information with the design information previously stored in the image providing unit 20. Thus, when the two kinds of information are not matched with each other, the storage unit transmits the updated design information to the image providing unit 20 so that the updated design information can be stored. Accordingly, the open type ordering system for enabling a wide choice of designs of the robot by the user using the present invention can be established.

Although the customized 3D printing robot having the specific shape and structure according to the present invention has been described with reference to the accompanying drawings for illustrative purposes, those skilled in the art will appreciate that various modifications, additions and substitutions are possible, without departing from the scope and spirit of the invention as disclosed in the accompanying claims.

What is claimed is:

1. A customized 3D printing robot:

a main body (110) assembled in such a manner as to be directly customized by a user using an image providing unit (20) in which design information for each component is stored and is to be outputted via a 3D printer (50);

a base (120) assembled in such a manner as to be directly customized by the user using the image providing unit (20) and to be outputted via the 3D printer (50), and having a driving means; and an assembly means (130) for connecting the main body (110) and the base (120), wherein the assembly means (130) includes:

an assembly member (131) composed of a protrusion portion (132) formed to protrude from a bottom of the main body (110), and a circular body, wherein the circular body is connected to an upper end of the protrusion portion (132) so as to be elastically supported inwardly from the bottom of the main body (110) and has a circular inclined portion (133A), a height of an upper surface being inclined to one side;

a pressure protrusion (135) installed to protrude around the assembly member (131) from the bottom of the main body (110) and having a ring portion (135A) in contact with the circular inclined portion (133A) at an upper end;

an assembly hole (136) that is provided in an upper surface of the base (120), and into which the protrusion portion (132) is inserted;

an elastic member (137) provided on the assembly hole (136) of the base (120) and having a circular twist portion (137A) inserted into a coupling groove (132A) of the protrusion portion; and a button portion (138) linked with a separation button provided at an outer side of the base to pressurize the pressure portion (137*b*) of the elastic member (137) exposed to an outer side of the assembly hole.

* * * * *